US007100418B2

(12) United States Patent
Jeske

(10) Patent No.: US 7,100,418 B2
(45) Date of Patent: Sep. 5, 2006

(54) METAL SHAPING APPARATUS

(76) Inventor: Christopher D. Jeske, 4438 Bass St., Tampa, FL (US) 33617

( * ) Notice: Subject to any disclaimer, the term of this patent is extended or adjusted under 35 U.S.C. 154(b) by 0 days.

(21) Appl. No.: 11/280,163

(22) Filed: Nov. 16, 2005

(65) Prior Publication Data

US 2006/0107728 A1 May 25, 2006

Related U.S. Application Data

(63) Continuation-in-part of application No. 10/994,103, filed on Nov. 22, 2004, now abandoned.

(51) Int. Cl.
*B21D 5/02* (2006.01)
*B21J 13/03* (2006.01)

(52) U.S. Cl. ..... 72/478; 72/415; 72/323

(58) Field of Classification Search ..... 72/323, 72/478, 415
See application file for complete search history.

(56) References Cited

U.S. PATENT DOCUMENTS 88,125 A * 3/1869 Brown ..... 72/477
201,827 A * 3/1878 Powers ..... 72/478
506,234 A * 10/1893 Hinsey ..... 72/477
1,324,492 A * 12/1919 Branson ..... 72/477
2,162,165 A * 6/1939 Gabel ..... 72/477
2,289,637 A * 7/1942 Earnest ..... 72/409.16
2,456,749 A * 12/1948 Steibel ..... 29/512
2,729,265 A * 1/1956 Jones ..... 72/466
2,762,414 A * 9/1956 Demler ..... 72/413
3,029,858 A * 4/1962 Harper ..... 72/412
4,653,307 A * 3/1987 Zbornik ..... 72/389.4
4,660,402 A * 4/1987 Hongo ..... 72/389.4
4,866,975 A * 9/1989 Hopkins ..... 72/448
5,199,293 A * 4/1993 Catti et al. ..... 72/443
5,868,024 A * 2/1999 Codatto ..... 72/323
6,170,314 B1 * 1/2001 Codatto ..... 72/316
6,196,041 B1 * 3/2001 Codatto ..... 72/323

* cited by examiner

*Primary Examiner*—David Jones
(74) *Attorney, Agent, or Firm*—A. W. Fisher, III

(57) ABSTRACT

A metal shaping apparatus to shape a metal blank into one of a plurality of configurations comprising a radius die including at least one substantially cylindrical die section having a plurality of metal blank receiving channels or slots formed therein to receive and shape the metal blank into one of the plurality of configurations.

13 Claims, 10 Drawing Sheets

SLOT 130

SLOT 124 & SLOT 134

METAL SHAPING APPARATUS

CROSS REFERENCE

This is a continuation-in-part application of application Ser. No. 10/994,103 filed Nov. 22, 2004, now abandoned.

BACKGROUND OF THE INVENTION

1. Field of the Invention

A metal shaping apparatus to shape a metal blank into one of a plurality of configurations.

2. Description of the Prior Art

U.S. Pat. No. 201,827 discloses a sheet metal pan machine comprising a metallic block or blocks containing a slot to receive the edge of the blank from which the pan is to be formed. The slot has inclination relative to the top of the block to give proper bevel to the sides of the pan. The block sections are removable to adjust the length of the machine for making of different sizes or shapes of pans.

U.S. Pat. No. 2,729,265 shows a metal forming tool to bend and shape linear metal strips comprising a plurality of cooperating pre-contoured solid block-like sections arranged end to end in closely spaced relation including a groove in each block-like section to receive a flexible metal member seated in and extending lengthwise then through the grooves.

U.S. Pat. No. 6,170,314 discloses a movable blank-holder of a bending press including a series of segments and a pair of motor-driven carriages each of which has an entraining member which can selectively engage and release the segments in order to move them for re-arrangement purposes. Each of two segments disposed at opposite ends of the series includes a shoe-holder to support a shoe to carry a respective slide having a driving portion and each shoe has a driven portion. These driving and driven portions have facing cooperating pressure and sliding faces arranged in a manner such that a movement of the slide towards the center of the press is converted into an oblique movement of the respective shoe such that it is released from a lateral channel-shaped bend already formed in a metal sheet without sliding on the sheet.

U.S. Pat. No. 5,868,024 teaches a bending press comprising a movable blank-holder formed by a series of sections in which two spaced-apart sections form shoes with projections pointing in opposite direction so that each can be engaged in a channel-shaped bend which has already been made. Each shoe is supported by a shoe-holder body by means of inclined guides such that when the movable blank-holder moves away from the fixed blank-holder, the two shoes move towards one another in order to release their projection from the channel-shaped bends. Each shoe and the respective shoe-holder body are interconnected by positive drive means for moving the shoe.

U.S. Pat. No. 6,196,041 relates to a guide means disposed between a blade-holder and the frame of a bending press comprising a slide movable along an axis perpendicular to the plane of the metal sheet to be bent. The blade-holder is coupled to the slide so as to be movable along an axis inclined to a plane perpendicular to the plane of the sheet.

U.S. Pat. No. 5,199,293 discloses a press comprising a pair of tool holders mounted in a frame to support a die and punch. At least one of the tool holders is motor driven and movable towards the other tool holder. The press includes a first driver arranged to make one of the tool holders travel towards the other tool and a second driver to make the same tool holder or the other tool holder perform a working stroke to bend the sheet metal and to effect any coining of the bend.

U.S. Pat. No. 4,653,307 shows a bending tool for a bending press comprising an upper die member detachably secured to a vertically reciprocable ram for bending a flat metal work-piece to a predetermined depth in a lower female bending die. The bottom surface of the female bending die cavity is formed by a plurality of flat headed pins in side by side slots or bores. The heads of the pins form the bottom flat surface of a longitudinal groove which forms the bottom die cavity surface. The vertical adjustment of the pins is provided by the interfitting combination of a left side wedge assembly, a middle wedge assembly and a right side wedge assembly. The interfitting prevents displacement of any one of the supporting assemblies for the pins to assure improved bending precision.

U.S. Pat. No. 4,660,402 relates to an apparatus for adjusting the tool length of a bending machine comprising a ram having a lower end, a top tool body mounted on the lower end of the ram, a bottom tool mounted below the top tool body, a top tool including a pair of central dies mounted longitudinally movably on the lower end of the ram, a plurality of upper split dies arranged outside the central dies and mounted reversibly to the upper die row, a plurality of thin upper dies inserted reversibly between the central dies and being thinner than the upper split die, and upper corner dies arranged on both left and right ends of the upper split die, a shift mechanism for sliding the central dies reversely at the central portion of the lower portion of the ram, a drive mechanism for sliding the upper corner dies to the longitudinally symmetrical positions of the lower portion of the ram, shafts pivotably disposed at the back of the central dies and upper corner dies, a plurality of the upper split dies wedged to the shafts and reversed in pivoting of the shaft to be selectively inserted between said central die and upper corner die, a wedge releasing mechanism for releasing the upper split die from the wedge to be received in the corresponding upper die in pivoting the shaft, and a mechanism for selecting the number of the thin upper dies supported by the shaft at the back of the central dies so as to be reversed.

U.S. Pat. No. 506,234 teaches a tinner's stake comprising a series of telescoping independently extendable sections each forming a guide and holder for the next smaller section.

SUMMARY OF THE INVENTION

The present invention relates to a metal shaping apparatus or radius bender to shape a metal blank into one of a plurality of configurations.

The present invention relates to a metal shaping apparatus or radius bender for shaping metal blank into a finished piece having one of a plurality of configurations.

The metal shaping apparatus or radius bender comprises a radius die support and a base.

The radius die comprises a plurality of die sections constructed of metal, plastic, wood or other suitable hard material.

A plurality of metal blank receiving/shaping recesses or slots is formed in the surface or periphery of each of the die sections selectively used to shape the metal blank into one of the plurality of configurations.

In use, an operator forms a bend in the metal blank to be shaped on a hand brake or similar device prior to shaping the metal blank on the metal shaping apparatus or radius bender. So prepared, the metal blank is placed or slipped into one of the plurality of metal blank receiving/shaping recess or slots.

The operator then bends or forms the metal blank around or over the surface of the die sections to shape the metal blank into the desired configuration. Once the metal blank is shaped in the desired configuration, the finished piece is removed from the metal blank receiving/shaping recess or slot of the metal shaping apparatus or radius bender.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the nature and object of the invention, reference should be had to the following detailed description taken in connection with the accompanying drawings in which.

Similar reference characters refer to similar parts throughout the several views of the drawings.

DETAILED DESCRIPTION OF THE INVENTION

Figure 1:
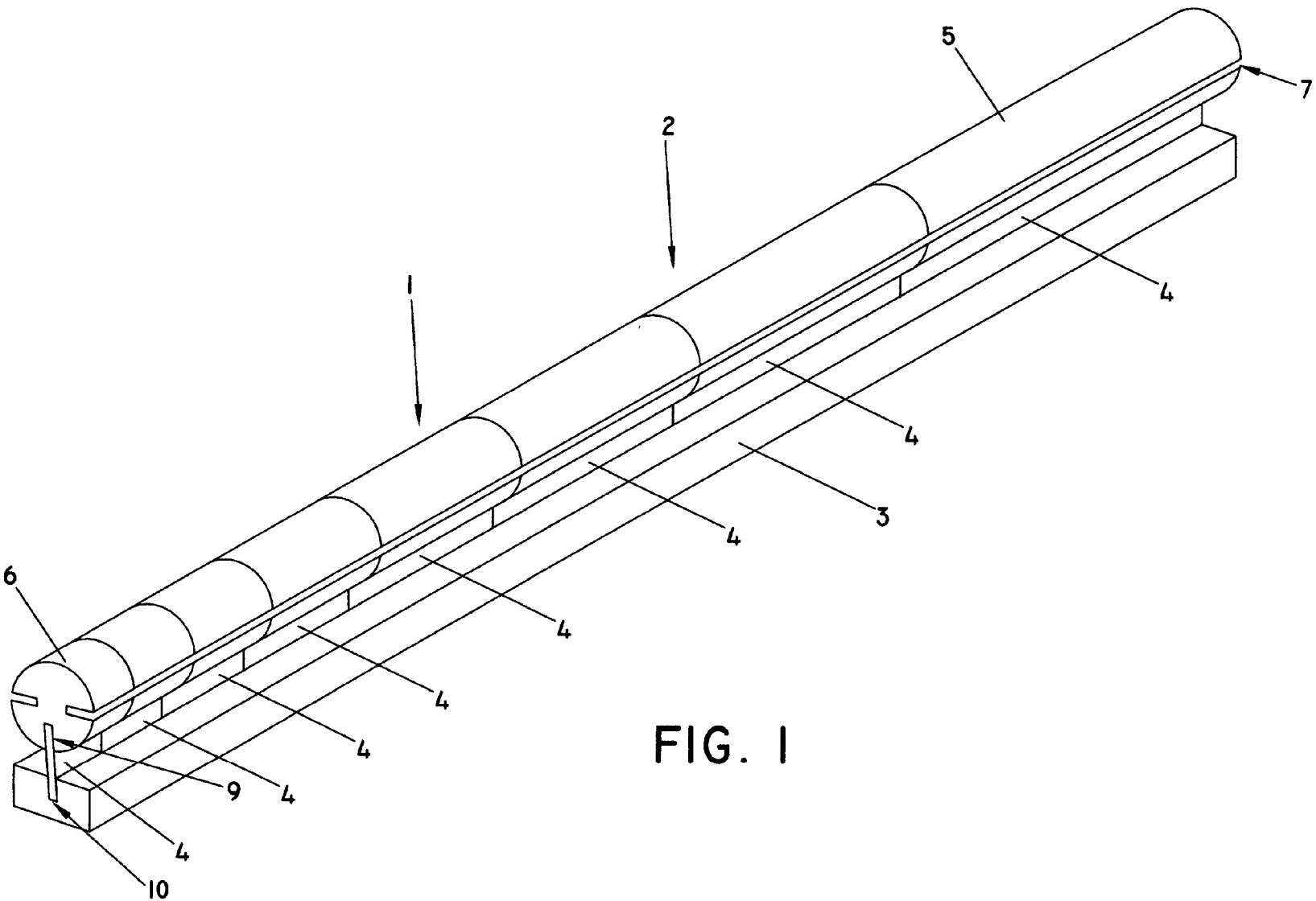
FIG. 1 is a perspective view of the metal shaping apparatus of the present invention.
Figure 2:
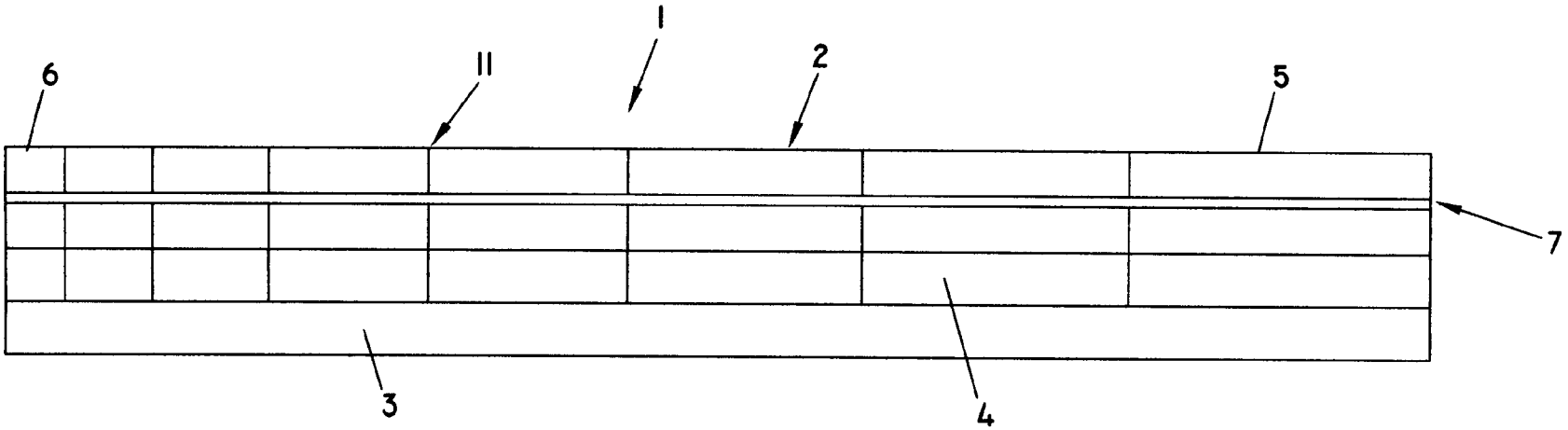
FIG. 2 is a view of one side of the metal shaping apparatus of the present invention.
Figure 3:
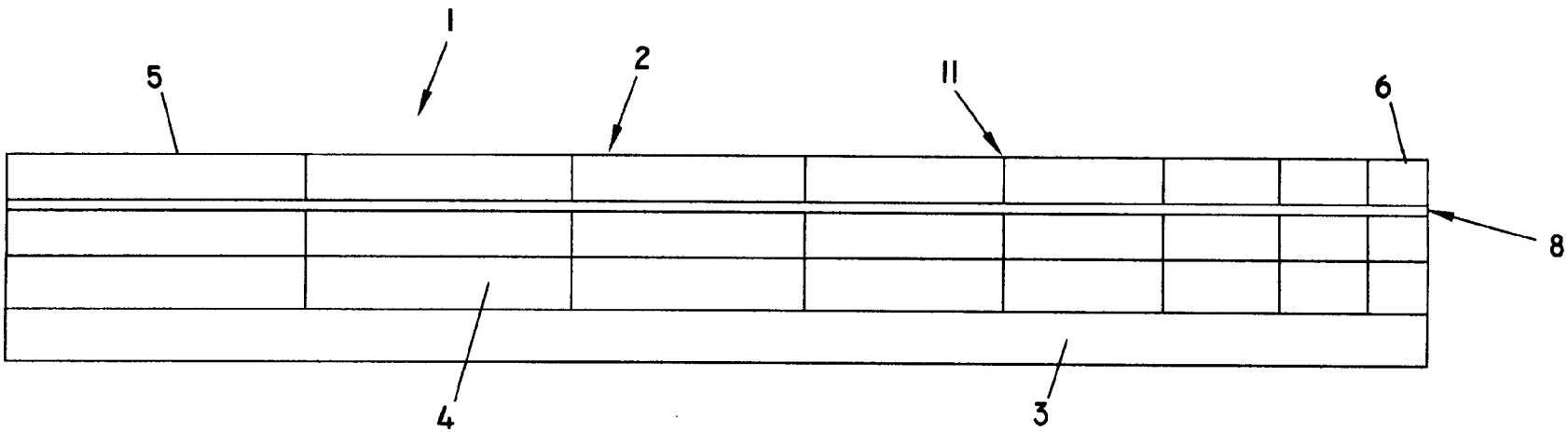
FIG. 3 is a view of the opposite side of the metal shaping apparatus of the present invention.
Figure 4:
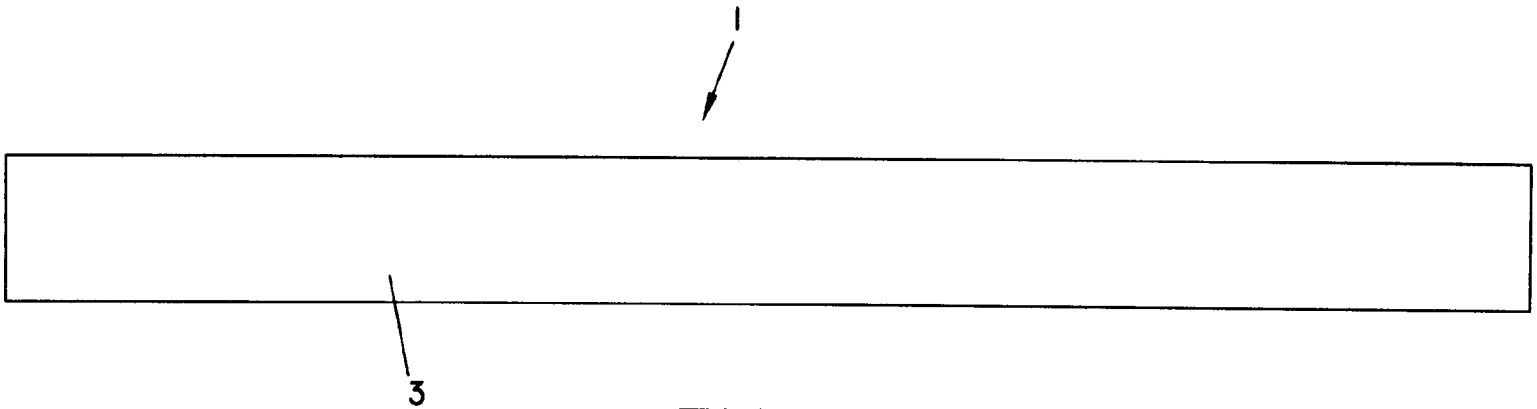
FIG. 4 is a bottom view of the metal shaping apparatus of the present invention.
Figure 5:
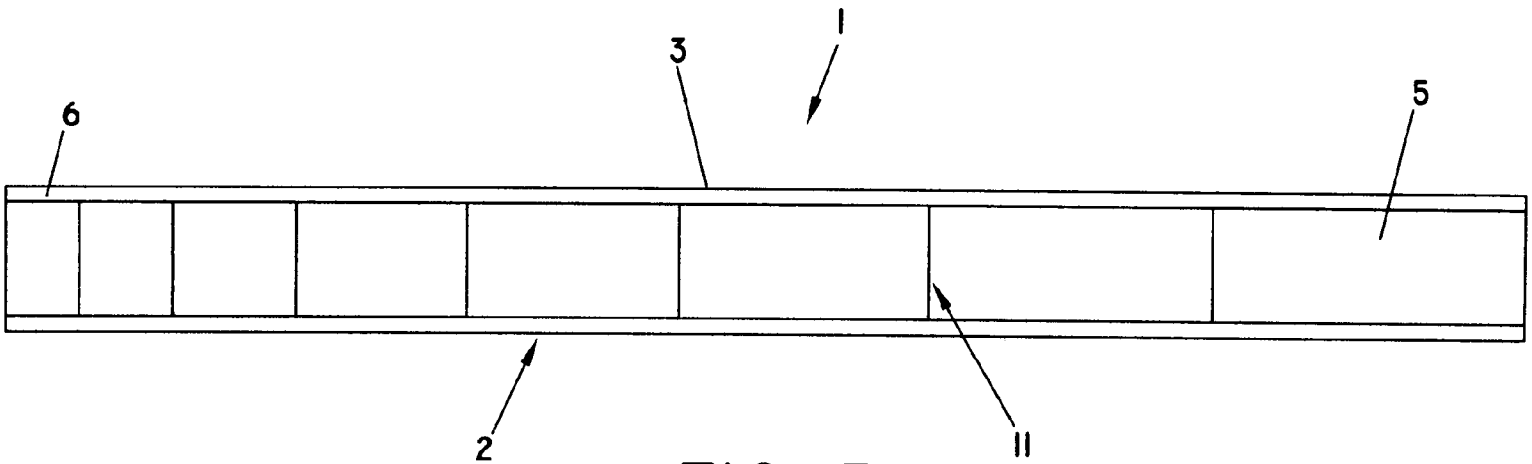
FIG. 5 is a top view of the metal shaping apparatus of the present invention.
Figure 6:
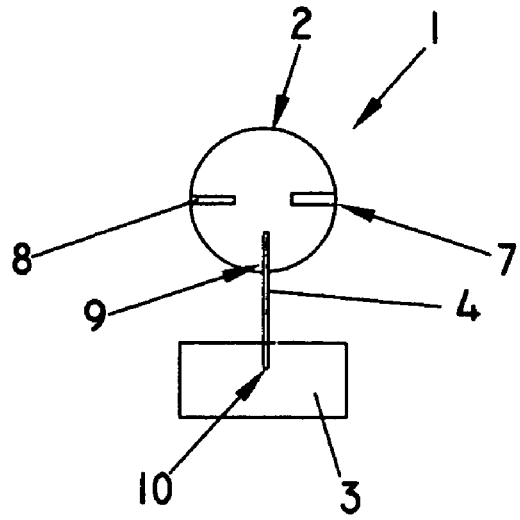
FIG. 6 is a view of one end of the metal shaping apparatus of the present invention.
Figure 7:
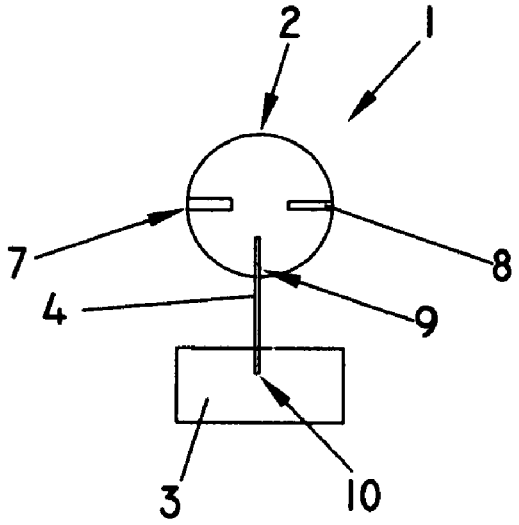
FIG. 7 is a view of the opposite end of the metal shaping apparatus of the present invention.

As shown in FIGS. 1 through 7, the present invention relates to a metal shaping apparatus or radius bender generally indicated as 1 to shape a metal blank into one of a plurality of configurations.

The metal shaping apparatus or radius bender 1 comprises a radius die generally indicated as 2 supported on a base 3 by a plurality of die plate sections or interconnecting support members each indicated as 4.

The radius die 2 comprises a plurality of substantially cylindrical die sections ranging in length from a large substantially cylindrical die section 5 to a small substantially cylindrical die section 6. At least two metal blank receiving/shaping recesses or slots 7 and 8 are formed on opposite sides of the radius die 2 to receive a metal blank to be shaped into one of the plurality of configurations.

Opposite end portions of each interconnecting support member 4 are secured or press fit into a corresponding die section slot 9 and a base slot 10 formed in the lower surface of each die section and the upper surface of the base 3 respectively.

Adjacent die sections engage each other shown as die sections parting lines 11.

In use, an operator forms a flange in the metal blank to be shaped on a hand brake or similar device prior to shaping the metal blank on the metal shaping apparatus or radius bender 1. So prepared, the flange is placed or slipped into either metal blank receiving/shaping recess or slot 7 or 8. The operator then bends or forms the metal blank around or over the surface of the substantially cylindrical die sections to shape the metal blank into the desired configuration. Once the metal blank is shaped in the desired configuration, the finished piece is removed from the metal blank receiving/shaping recess or slot 7 or 8 of the metal shaping apparatus or radius bender 1.

Figure 14:
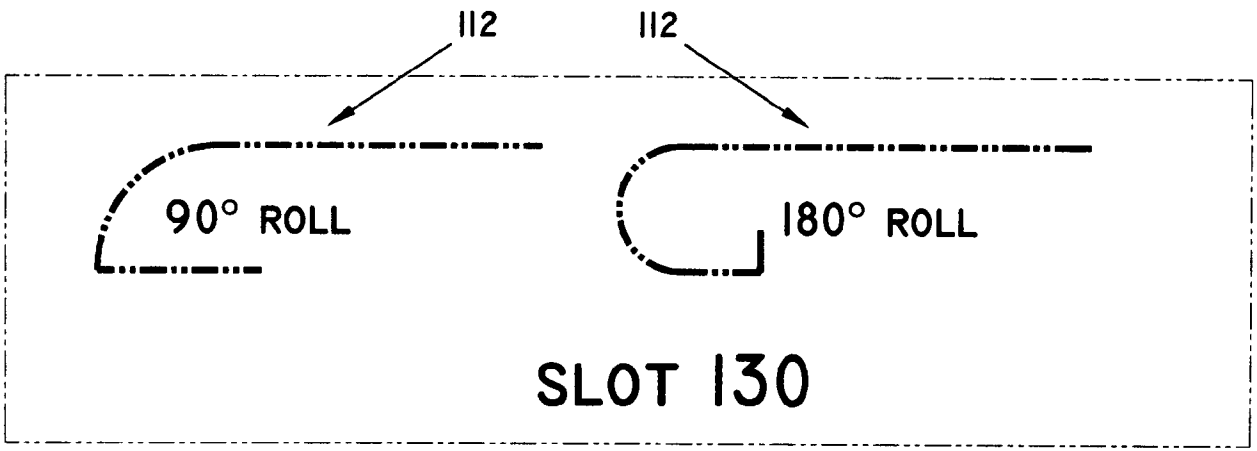
FIG. 14 depicts configurations shaped using the offset metal blank receiving/forming slot or recess.
Figure 15:
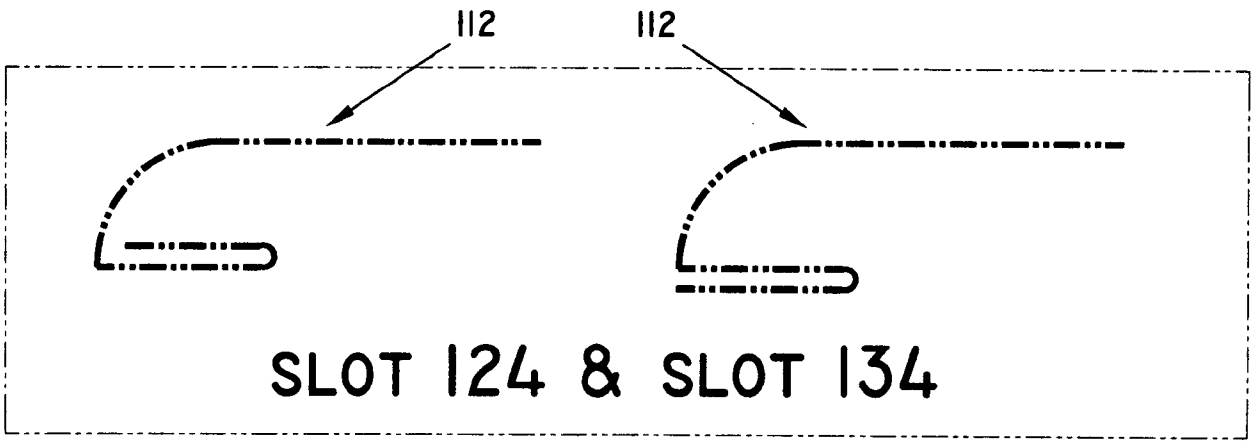
FIG. 15 depicts configurations shaped using the centrally aligned metal blank receiving/forming slot or recess, or the T-shaped metal blank receiving/forming slot or recess.
Figure 16:
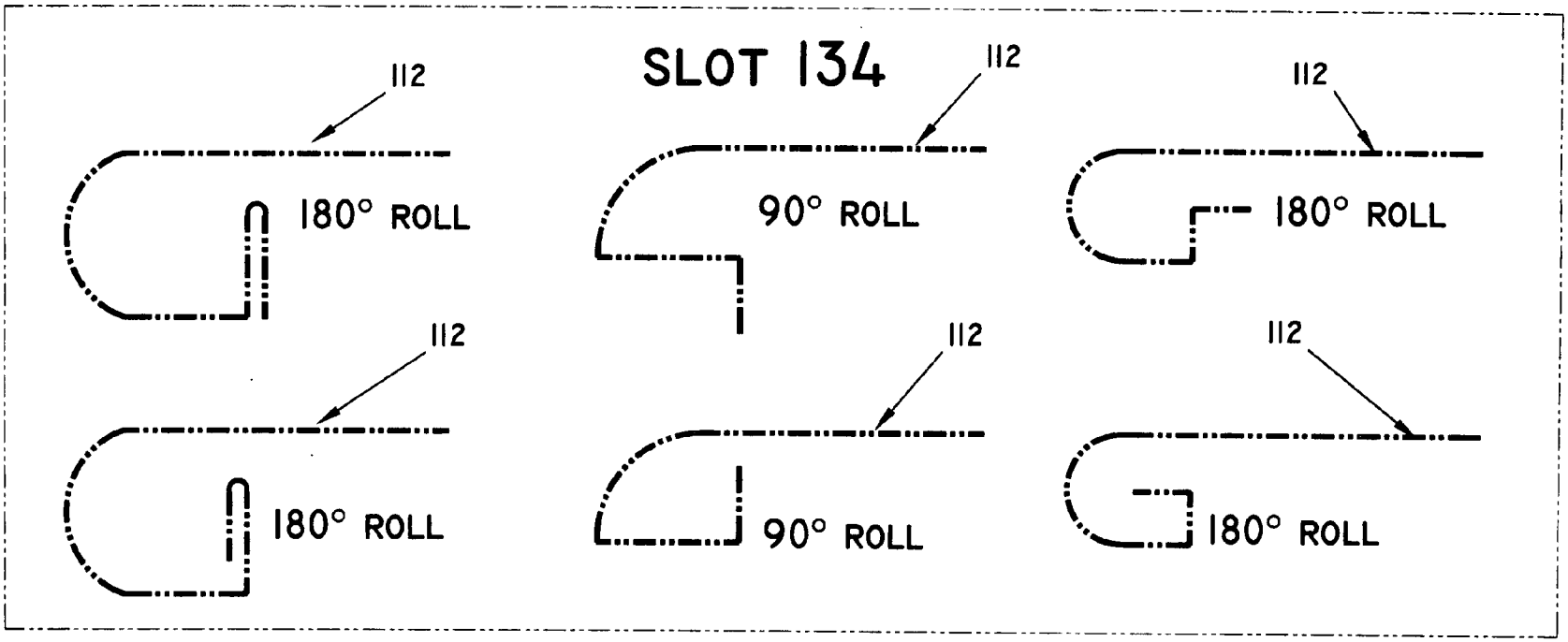
FIG. 16 depicts configurations shaped using the T-shaped metal blank receiving/forming slot or recess.
Figure 17:
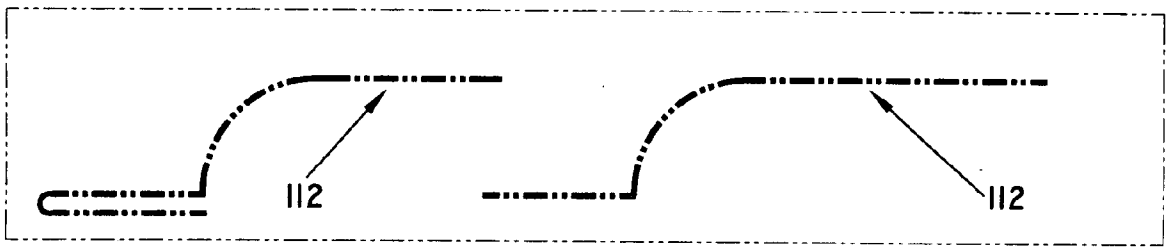
FIG. 17 depicts the configuration shaped using the substantially t-shaped reverse bend jig.

FIGS. 8 through 13 depict an alternate embodiment of a metal shaping apparatus or radius bender generally indicated as 110 for shaping metal blank generally indicated as 112 into a finished piece generally indicated as 114 as shown in FIGS. 14 through 16.

The metal shaping apparatus or radius bender 110 comprises a radius die generally indicated as 116 supported on a base generally indicated as 118.

The radius die 116 comprises a plurality of substantially cylindrical die sections each indicated as 120 that may range in width from 2" to 3" to 4" to 6" to 8" to 10" to 12" to 15" for a total width of approximately 60". The substantially cylindrical die sections 120 may be constructed of metal, plastic, wood or other suitable hard material. Preferably, the substantially cylindrical die sections 120 are constructed of ultra high molecular weight (UHMW) polyethylene. The radius bend formed on the metal shaping apparatus 110 is determined by the diameter of the substantially cylindrical die sections 120. A 2" or 3" diameter is preferable.

A plurality of metal blank receiving/shaping recesses or slots is formed in the surface or periphery 122 of each of the substantially cylindrical die sections 120. Specifically, the plurality of metal blank receiving/shaping recesses or slots includes a centrally aligned metal blank receiving/shaping recess or slot 124 having a central axis 126 aligned with or passing through the center 128 of the corresponding substantially cylindrical die section 120, an offset metal blank receiving/shaping recess or slot 130 having a central axis 132 inclined or offset relative to the center 128 of the corresponding substantially cylindrical die section 120 to form an angle A of from about 6 degrees to about 8 degrees and a substantially T-shaped metal blank receiving/shaping recess or slot generally indicated as 134 including an outer slot portion 136 having a central axis 138 aligned with or passing through the center 128 of the corresponding substantially cylindrical die section 120 and an inner recess portion 140 having a central axis 142 intersecting the central axis 138 at a substantially 90 degree angle B. The centrally aligned metal blank receiving/shaping recess or slot 124, the offset metal blank receiving/shaping recess or slot 130 and the substantially T-shaped metal blank receiving/shaping recess or slot 134 is each about one-half inch deep.

Figure 10:
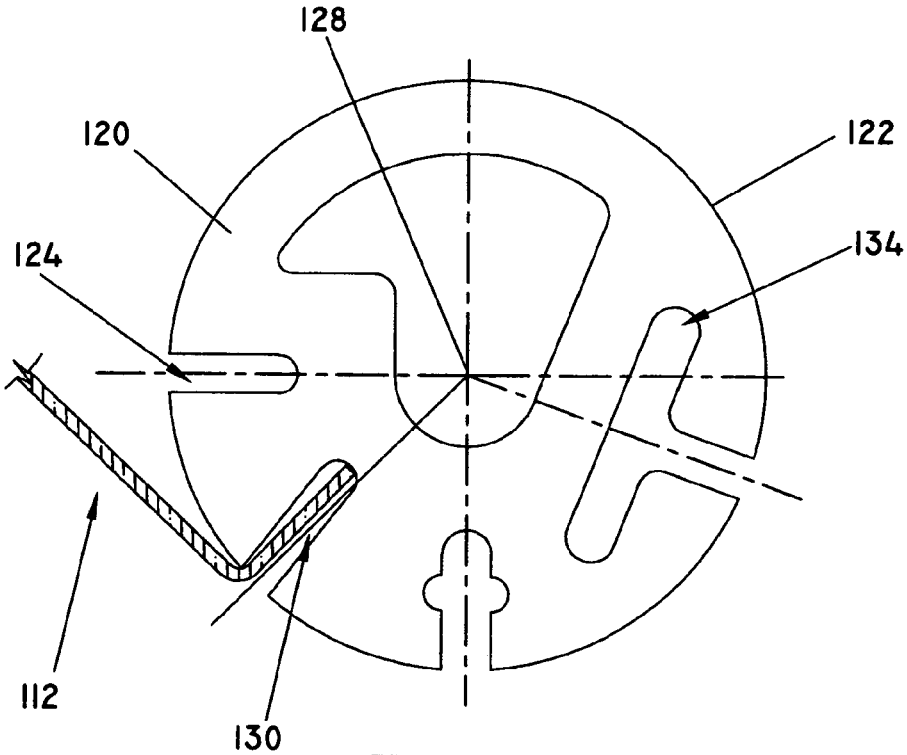
FIG. 10 is a detailed end view of the radius die of the alternate embodiment of the metal shaping apparatus of the present invention using the offset metal blank receiving/forming slot or recess with a single ply 90 degree flange.
Figure 11:
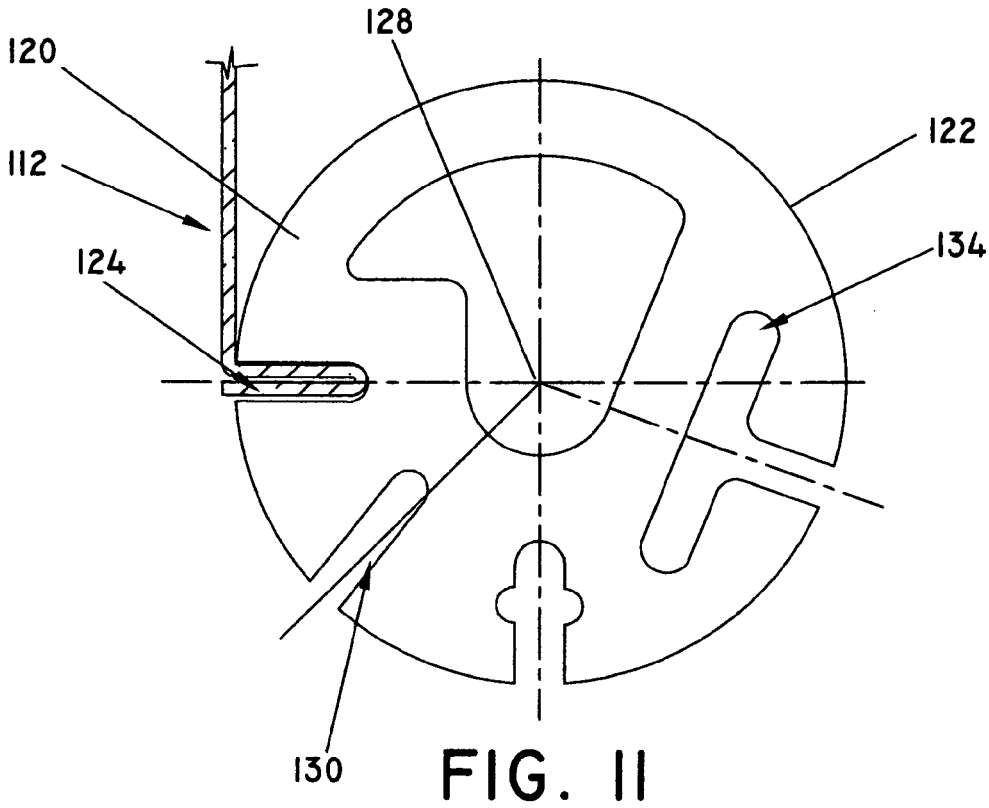
FIG. 11 is a detailed end view of the radius die of the alternate embodiment of the metal shaping apparatus of the present invention using the centrally aligned metal blank receiving/forming slot or recess with a double ply 90 degree flange.
Figure 12:
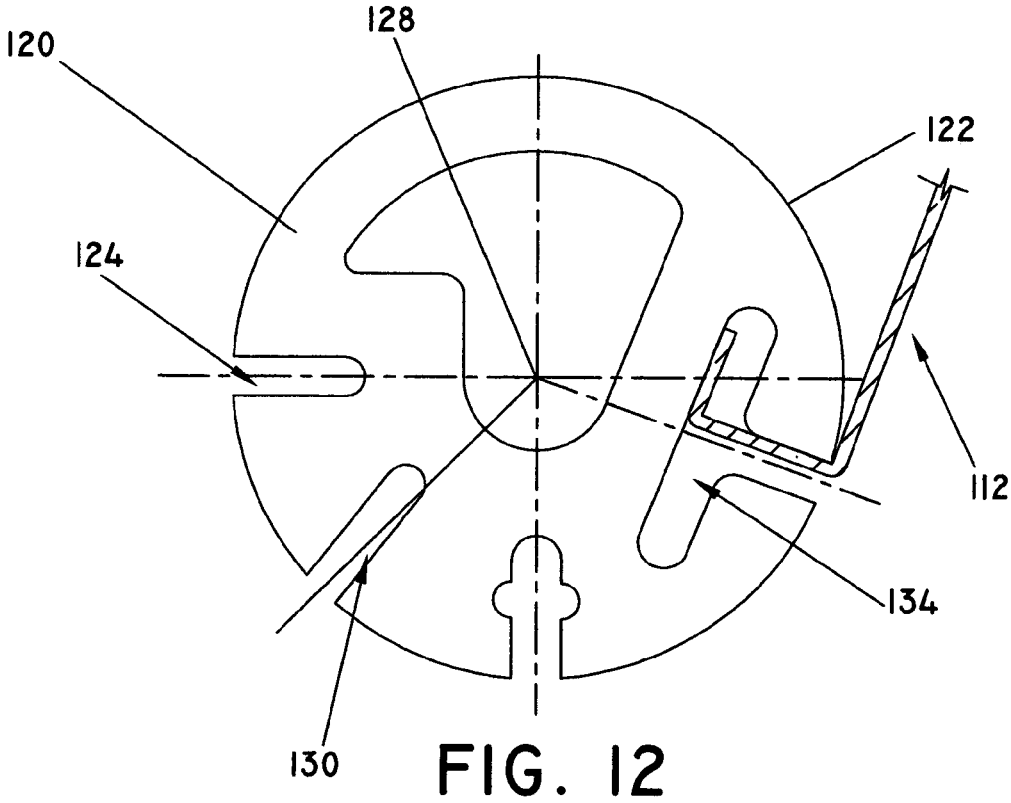
FIG. 12 is a detailed end view of the radius die of the alternate embodiment of the metal shaping apparatus of the present invention using the T-shaped metal blank receiving/forming slot or recess with a two inside 90 degree bend/flange.
Figure 13:
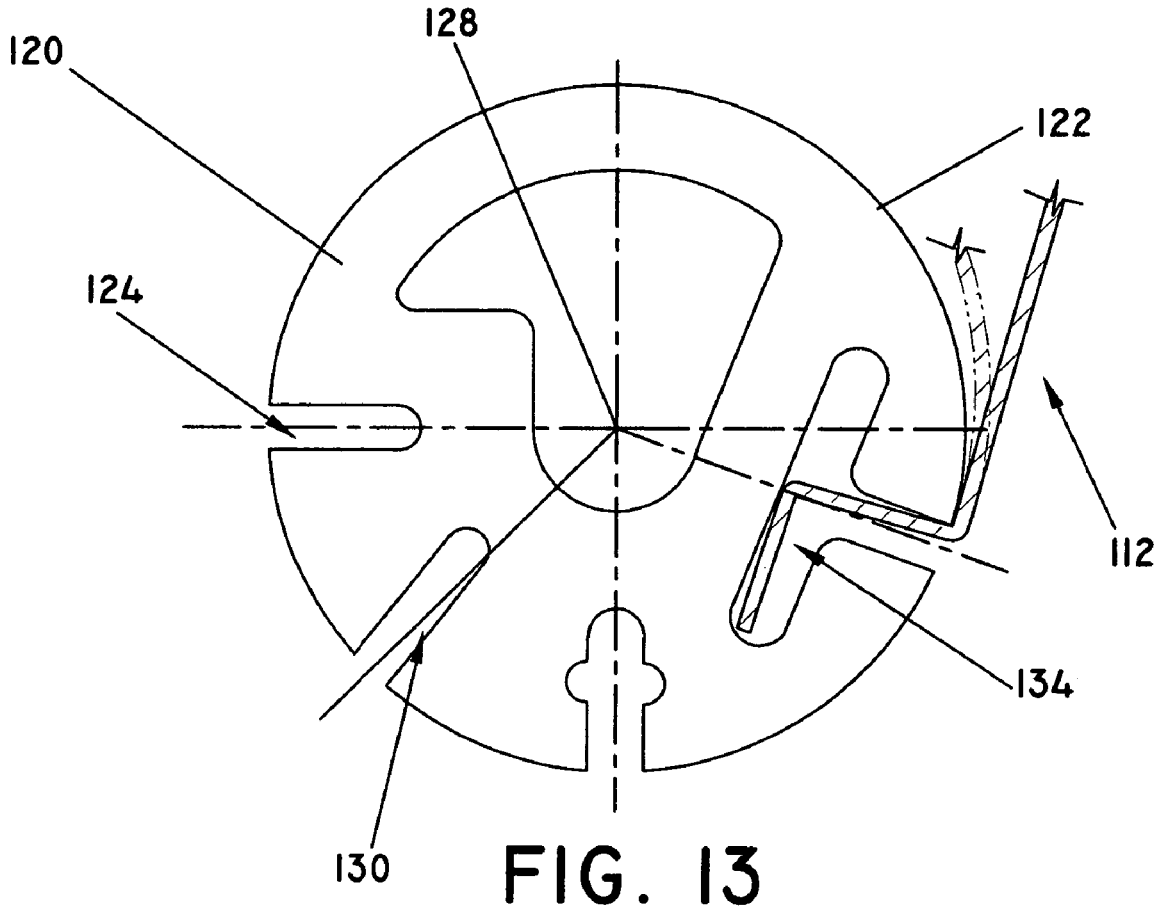
FIG. 13 is a detailed end view of the radius die of the alternate embodiment of the metal shaping apparatus of the present invention using the T-shaped metal blank receiving/forming slot or recess with a two outside 90 degree bend/flange.

The offset metal blank recess or slot 130 allows the metal blank 112 to rest loosely therein and create a substantially 90 degree bend at the surface 122 as best shown in FIG. 10.

The centrally aligned metal blank receiving/shaping recess or slot 124, the offset metal blank receiving/shaping recess or slot 130 and the outer slot portion 136 of each substantially cylindrical die section 120 are about 0.13, about 0.18 and about 0.198 inches wide respectively. The centers of the centrally aligned metal blank receiving/shaping recess or slot 124, the offset metal blank receiving/shaping recess or slot 130 and the outer slot portion 136 of the substantially T-shaped metal blank receiving/shaping recess or slot 134 at the surface 122 of each corresponding substantially cylindrical die section 120 are located about 122.5 degrees, about 228 degrees and about 270 degrees around the circumference of each corresponding substantially cylindrical die section 120 respectively.

Figure 8:
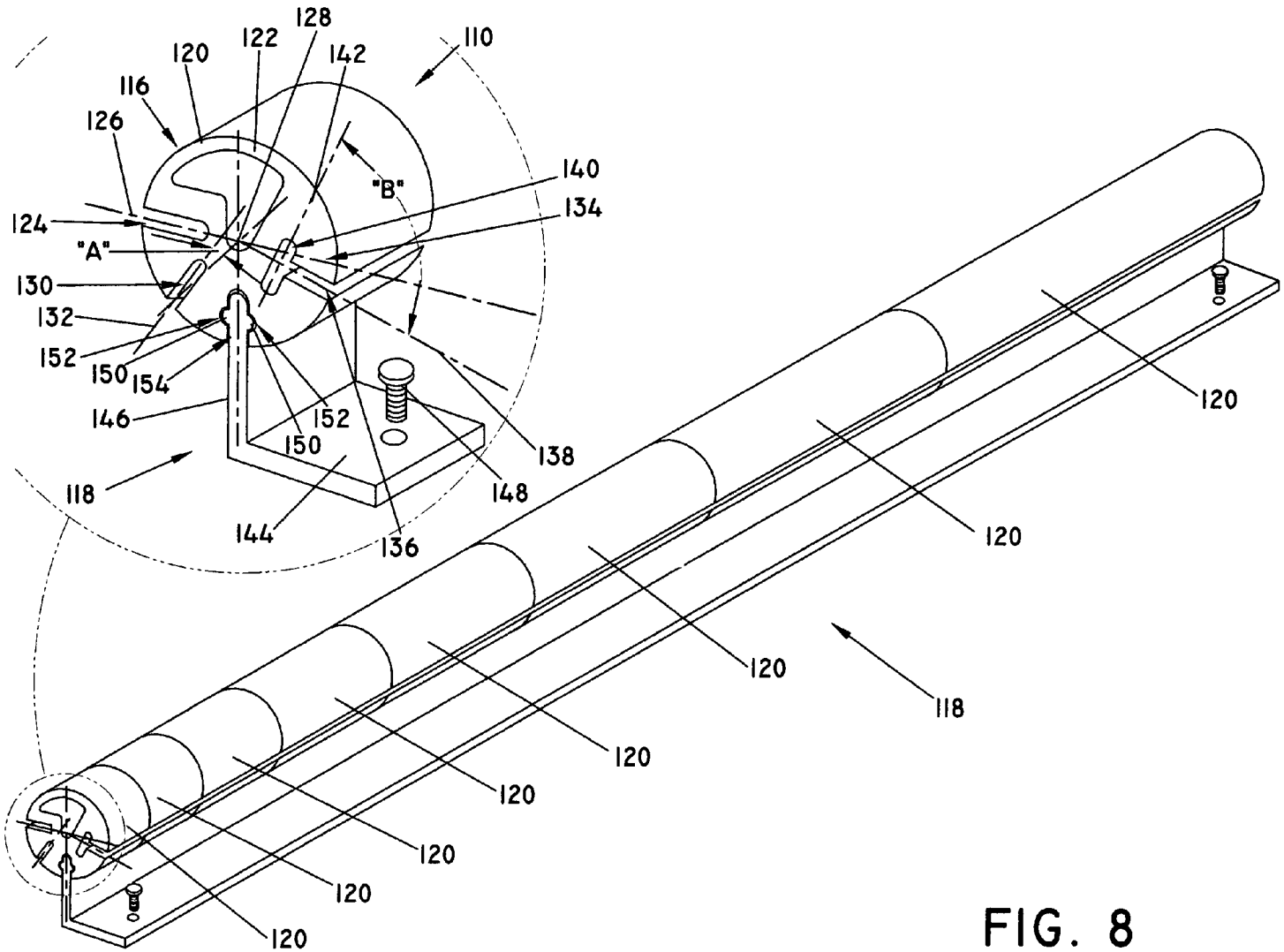
FIG. 8 is a perspective view an alternate embodiment of the metal shaping apparatus of the present invention.
Figure 9:
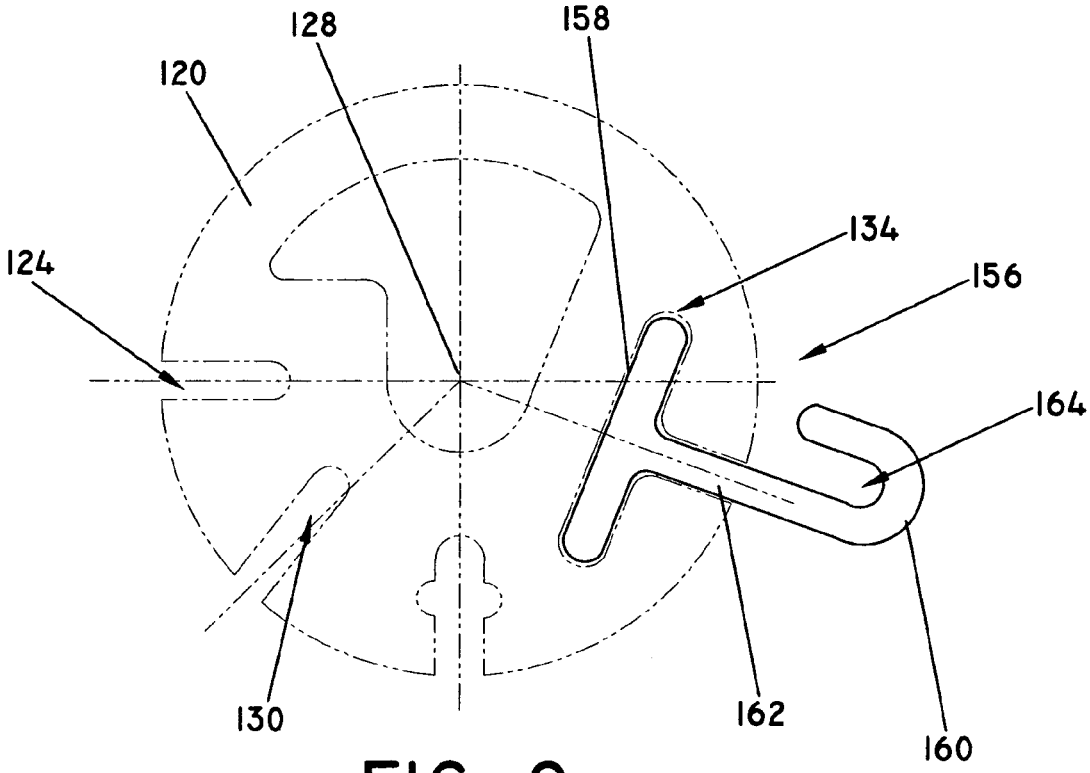
FIG. 9 is a detailed end view of the radius die of the alternate embodiment of the metal shaping apparatus of the present invention using the offset metal blank receiving/forming slot or recess with the substantially T-shaped reverse bend jig.

As shown in FIG. 8, the base 118 may comprise a substantially L-shaped die support extending substantially the length of the radius die 116 and a substantially flat base member 144 having an interconnecting support member 146 extending upwardly therefrom. The substantially flat base member 144 is secured to a floor or other support surface by a plurality of bolts each indicated as 148 or securely held in a vice of hand brake. The upper portion of the interconnecting support member 146 includes a pair of protrusions each indicated as 150 to rest or engage the surfaces of a corresponding pair of channels each indicated as 152 formed on opposite sides of a base receiving recess or slot 154 to secure the base 118 to the radius die 116.

The metal shaping apparatus or radius bender 110 may also include a substantially t-shaped reverse bend jig generally indicated as 156 to form a reverse bend. Specifically, substantially t-shaped reverse bend 156 comprises an inner cross-member 158 connected to a substantially U-shaped outer member 160 by an interconnected member 162. The substantially U-shaped outer member 160 comprises a reverse bend metal blank receiving/shaping recess or slot 164. The substantially t-shaped reverse bend jig 156 is configured and sized to be operatively disposed with the substantially T-shaped metal blank receiving/shaping recess or slot 134 when in use.

In use, an operator forms a single ply flange (FIG. 10), a double ply flange (FIG. 11), a double inside flange (FIG. 12), or double outside flange (FIG. 13) or similar configuration from a metal blank 112 shaped on a hand brake or similar device prior to shaping the metal blank 112 on the metal shaping apparatus or radius bender 10. So prepared, the single or double flange metal blank 112 is placed or slipped into the appropriate metal blank receiving/shaping recess or slot 124, 130 or 134. The operator then bends or forms the metal blank 112 around or over the surface of the substantially cylindrical die sections 120 to shape the metal blank 112 into the desired configuration. Once the metal blank 112 is shaped in the desired configuration, the finished piece 114 is removed from the metal blank receiving/shaping recess or slot 124, 130 or 134 of the metal shaping apparatus or radius bender 110. As illustrated, the finished piece 114 may include a bend from about 0 degrees to about 180 degrees.

It will thus be seen that the objects set forth above, among those made apparent from the preceding description are efficiently attained and since certain changes may be made in the above construction without departing from the scope of the invention, it is intended that all matter contained in the above description or shown in the accompanying drawing shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. A metal shaping apparatus to shape a metal blank into one of a plurality of configurations comprising a radius die including at least one die section including a longitudinal center axis and an outer periphery having a plurality of metal blank receiving/shaping recesses formed therein to receive and shape the metal blank into one of the plurality of configurations, wherein said plurality of metal blank receiving/shaping recesses includes a centrally aligned metal blank receiving/shaping recess having a central axis aligned with and passing through said longitudinal center axis of said die section, an offset metal blank receiving/shaping recess having a central axis offset relative to said longitudinal center axis of said die section to form an angle therebetween and a metal blank receiving/shaping recess including an outer slot portion having a central axis aligned with and passing through said longitudinal center axis of said die section, said metal blank receiving/shaping recess has an inner recess portion having a central axis intersecting said central axis of said metal blank receiving/shaping recess to form an angle therebetween.

2. The metal shaping apparatus of claim 1 wherein the angle formed between the central axis of the inner recess portion and the central axis of the outer slot portion is substantially 90 degrees.

3. The metal shaping apparatus of claim 1 wherein the centrally aligned metal blank receiving/shaping recess, the offset metal blank receiving/shaping recess and the metal blank receiving/shaping recess is each about one-half inch deep.

4. The metal shaping apparatus of claim 1 wherein the centrally aligned metal blank receiving/shaping recess, the offset metal blank receiving/shaping recess and the outer slot portion of each die section are about 0.13, about 0.18 and about 0.198 inches wide respectively.

5. The metal shaping apparatus of claim 1 wherein the centers of the centrally aligned metal blank receiving/shaping recess, the offset metal blank receiving/shaping recess and the outer slot portion of the metal receiving/shaping recess at the surface of said die section are located about 122.5 degrees, about 228 degrees and about 270 degrees on said outer periphery of said die section.

6. The metal shaping apparatus of claim 1 wherein said angle formed between said central axis of said offset metal blank receiving/shaping recess and said longitudinal center axis is from about 6 degrees to about 8 degrees.

7. A metal shaping apparatus to shape a metal blank into one of a plurality of configurations comprising a radius die including at least one die section including a longitudinal center axis and an outer periphery having a plurality of metal blank receiving/shaping recesses formed therein to receive and shape the metal blank into one of the plurality of configurations and a base comprising a base member coupled to said die section by an interconnecting support member including an upper portion extending upwardly therefrom to support said die section thereon and a base receiving recess having a pair of channels formed therein and said upper portion of said interconnecting support member includes a pair of protrusions to engage said pair of channels formed in said base receiving recess formed in said die section.

8. A metal shaping apparatus to shape a metal blank into one of a plurality of configurations comprising a radius die including at least one die section including a longitudinal center axis and an outer periphery having a plurality of metal blank receiving/shaping recesses formed therein to receive and shape the metal blank into one of the plurality of configurations further including a reverse bend jig to form reverse bends coupled to said die section.

9. The metal shaping apparatus of claim 8 wherein the substantially T-shaped reverse bend jig comprises an inner cross-member connected to a substantially U-shaped outer member by an interconnected member.

10. The metal shaping apparatus of claim 9 wherein said substantially U-shaped outer member comprises a reverse bend metal blank receiving/shaping recess.

11. A metal shaping apparatus to shape a metal blank into one of a plurality of configurations comprising a radius die including at least one die section including a longitudinal center axis and an outer periphery having a plurality of metal blank receiving/shaping recesses formed therein to receive and shape the metal blank into one of the plurality of configurations, said plurality of metal blank receiving/shaping recesses including an offset metal blank receiving/shaping recess having a central axis offset relative to said longitudinal center axis of said die section to form an angle therebetween and a metal blank receiving/shaping recess including an outer slot portion having a central axis aligned with and passing through said longitudinal center axis of said die section, said metal blank receiving/shaping recess has an inner recess portion having a central axis intersecting said central axis of said metal blank receiving/shaping recess to form an angle therebetween.

12. The metal shaping apparatus of claim 11 wherein the angle formed between the central axis of the inner recess portion and the central axis of the outer slot portion is substantially 90 degrees.

13. A metal shaping apparatus to shape a metal blank into one of a plurality of configurations comprising a radius die including at least one die section including a longitudinal center axis and an outer cylindrically shaped surface having a plurality of metal blank receiving/shaping recesses formed therein to receive and shape the metal blank into one of the plurality of configurations, said plurality of metal blank receiving/shaping recesses including a centrally aligned metal blank receiving/shaping recess having a central axis aligned with and passing through said longitudinal center axis of said die section and an offset metal blank receiving/shaping recess having a central axis offset relative to said longitudinal center axis of said die section and said central axis of said centrally aligned metal blank receiving/shaping recess to form angles therebetween.

* * * * *